United States Patent [19]

Takano et al.

[11] 4,085,837

[45] Apr. 25, 1978

[54] VERTICAL TABULATION CONTROL FOR HIGH SPEED PRINTER

[75] Inventors: Rikuo Takano, Musashino; Yutaka Ohta, Kodaira; Yuji Sumitomo, Nara; Yoichi Shimazawa, Yamatokoriyama; Masahiko Aiba, Nara, all of Japan

[73] Assignees: Nippon Telegraph and Telephone Public Corporation; Sharp Kabushiki Kaisha, both of Japan

[21] Appl. No.: 683,960

[22] Filed: May 6, 1976

[30] Foreign Application Priority Data

May 8, 1975 Japan ..... 50-55694

[51] Int. Cl.[2] ..... B41J 15/00

[52] U.S. Cl. ..... 197/133 R; 197/19; 197/12

[58] Field of Search ..... 197/12, 19, 20, 64, 197/133 R

[56] References Cited

U.S. PATENT DOCUMENTS

| | | | |
|---|---|---|---|
| 3,040,860 | 6/1962 | Montross et al. | 197/133 R X |
| 3,344,899 | 10/1967 | Wang et al. | 197/12 |
| 3,502,190 | 3/1970 | Smith | 197/133 R |
| 3,670,861 | 6/1972 | Zenner et al. | 197/64 |
| 3,805,940 | 4/1974 | Stockham | 197/20 |
| 3,856,128 | 12/1974 | Taggart | 197/133 R |
| 3,923,139 | 12/1975 | Mesnil et al. | 197/19 |
| 3,930,570 | 1/1976 | Fletcher | 197/133 R X |

*Primary Examiner*—Ernest T. Wright, Jr.

*Attorney, Agent, or Firm*—Birch, Stewart, Kolasch & Birch

[57] ABSTRACT

A vertical tabulation control for a high speed printer comprises a presettable memory, such as a random access memory (RAM), for storing vertical tabulation addresses, a counter for counting the number of line feed operations, a comparator for developing a continuous line feed termination command when the contents of the counter reach the preset vertical tabulation address, and a rechargeable battery means which is charged when the printer is activated through a power switch. The rechargeable battery supplies the presettable memory and the counter with a necessary voltage for maintaining their contents when the power supply through the power switch is terminated.

11 Claims, 4 Drawing Figures

FIG. 2 (PAPER FEED -10-)
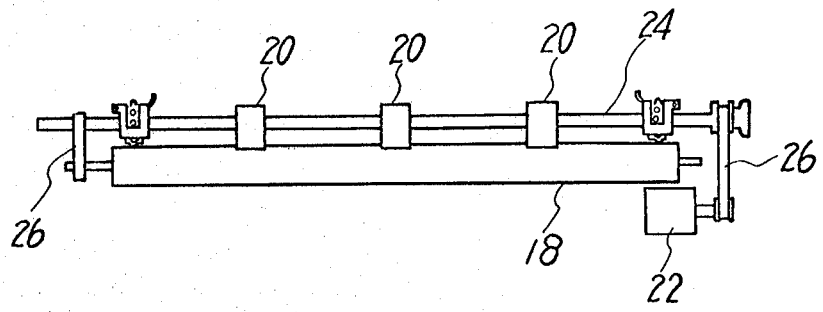
FIG. 4
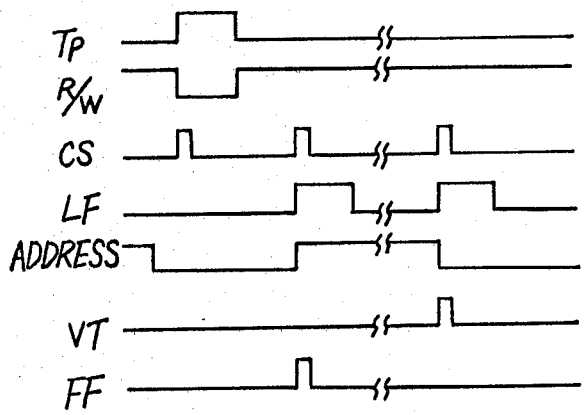

VERTICAL TABULATION CONTROL FOR HIGH SPEED PRINTER

BACKGROUND OF THE INVENTION

The present invention relates to a vertical tabulation control in a paper feed system for a high speed printer.

In a high speed printer for, especially, use as an output means of a computer, a continuous line feed operation is electrically achieved in order to arrange a desired print format. One control is to continuously feed the paper in a vertical direction to a predetermined line position when a predetermined control signal is derived from the computer. Such a control signal is called "vertical tabulation signal," and the predetermined line position is called "vertical tabulation position."

Another control is to automatically advance the page. A control signal for instructing the page advance is called "form feed signal," and the form feed operation is completed by detecting the number of line feed operations.

A prior system for achieving the above-mentioned vertical tabulation was controlled through the use of a format tape. This prior art system was very inconvenient because the format tape must be exchanged each time when the printing paper is exchanged, the vertical tabulation positions are changed, and the format tape is damaged. Moreover, the mechanism associated with the format tape was unvoidably complicated.

OBJECTS AND SUMMARY OF THE INVENTION

Accordingly, an object of the present invention is to provide an electronic vertical tabulation control circuit for a high speed printer.

Another object of the present invention is to provide an electronic vertical tabulation control circuit which can store vertical position information even when the power supply through a power switch is terminated.

Still another object of the present invention is to provide an electronic vertical tabulation control circuit into which desired vertical position information can be easily introduced.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to an embodiment of the present invention, a presettable semiconductor memory, such as a random access memory (RAM), is provided for storing vertical tabulation addresses. The system further comprises a counter for counting the number of line feed operations, and a digital comparator for developing a continuous line feed termination command when the contents of the counter reach the preset vertical tabulation address stored in the presettable semiconductor memory.

In a preferred form, the present system further includes a rechargeable battery means which is charged when the system is activated through a power switch. The rechargeable battery supplies the presettable semiconductor memory and the counter with a necessary voltage for maintaining their contents when the power supply through the power switch is terminated. Digital switches are further disposed on a control panel of the printer in order to introduce desired information into the presettable semiconductor memory, and to determine the line number to be included within one page.

BRIEF DESCRIPTION OF THE DRAWING

The present invention will become more fully understood from the detailed description given hereinbelow and the accompanying drawing which are given by way of illustration only, and thus are not limitative of the present invention and wherein.

FIG. 2 is a front view of a paper feed mechanism employed in the high speed printer of FIG. 1;

FIG. 4 is a time chart showing various signals occurring within the vertical tabulation control of FIG. 3.

DESCRIPTION OF THE PREFERRED EMBODIMENTS

Figure 1:
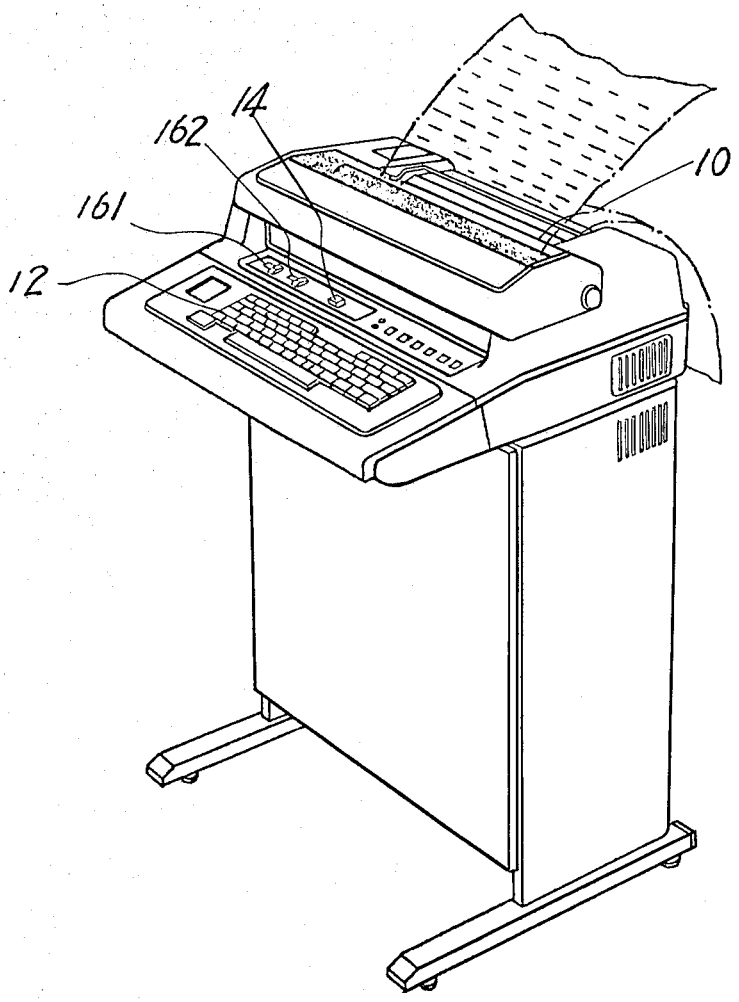
FIG. 1 is a perspective view of a high speed printer including a vertical tabulation control of the present invention.

Referring now in detail to the drawing, and to facilitate a more complete understanding of the present invention, a high speed printer employing a vertical tabulation control of the present invention will be first described with reference to FIG. 1.

A high speed printer, such as an ink jet system printer of the charge amplitude controlling type having a travelling printing head, for use as an output means of a computer, usually comprises a printing head and a paper feed mechanism 10. The high speed printer, in a preferred form, further includes a keyboard means 12 for information entry, which provides the printer with the capability to be used as an input means for data transmission or computer systems. The high speed printer employing the vertical tabulation control of the present invention further comprises a vertical tabulation set switch 14 and digital switches 161 and 162 for setting the vertical tabulation positions, of which the detailed operation mode will be described later with reference to FIG. 3.

A typical construction of the paper feed mechanism 10 is schematically shown in FIG. 2. A platen 18 and paper feed rollers 20 are driven by a pulse motor 22 through a driving shaft 24 and timing belts 26. One example of the paper feed mechanism and the printing head drive mechanism is shown in U.S. Pat. No. 3,670,861 "CARRIAGE DRIVE FOR HIGH SPEED PRINTER" granted to Walter J. Zenner et al, issued on June 20, 1972 and, therefore, details thereof are omitted from this detailed description for the purpose of simplicity.

Figure 3:
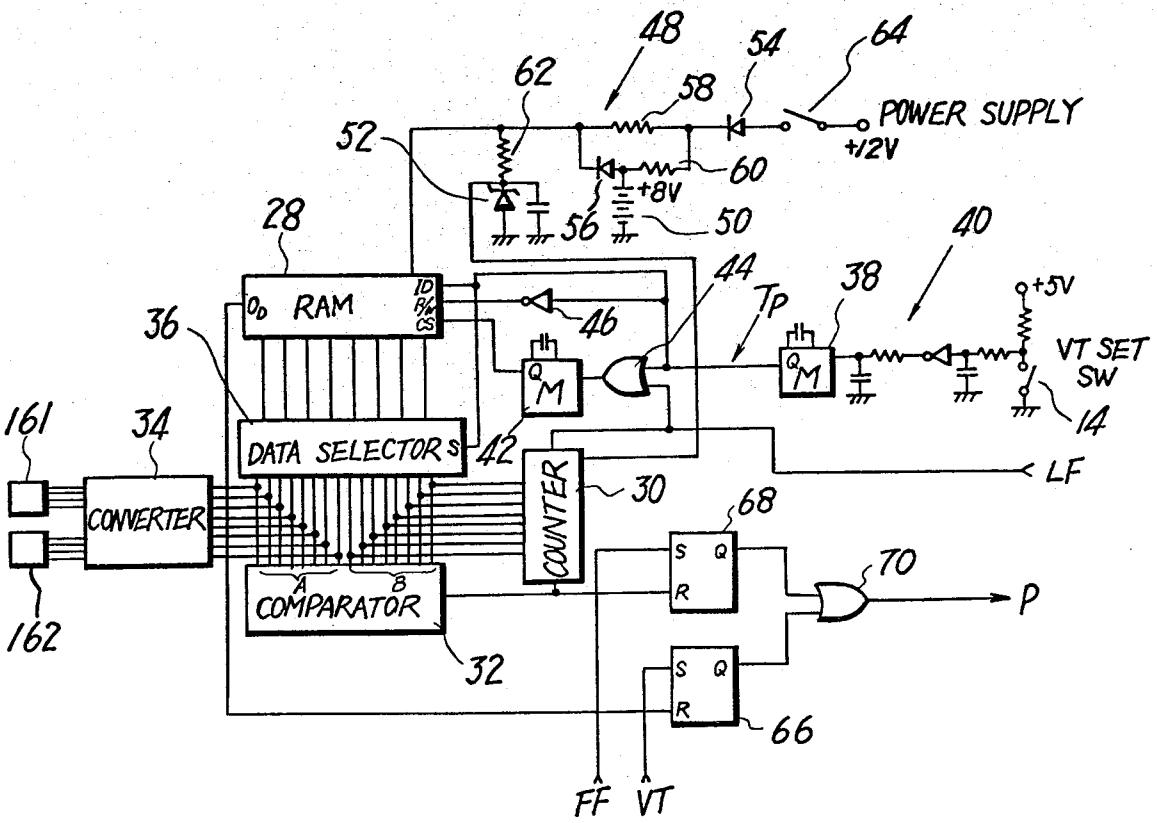
FIG. 3 is a circuit diagram of the vertical tabulation control of the present invention.

FIG. 3 shows an embodiment of the vertical tabulation control circuit of the present invention, which mainly comprises a random access memory (RAM) 28, a counter 30 and a digital comparator 32.

Desired information, such as vertical tabulation position information is introduced from the digital switches 161 and 162 to the random access memory (RAM) 28 through a code converter 34 and a data selector 36. The counter 30 is connected to receive a line feed signal LF associated with the pulse motor 22 employed in the paper feed mechanism 10 shown in FIG. 2, thereby to store the information corresponding to the number of line feed operations. Output signals of the counter 30 are applied to one group of terminals of the data selector 36 and to a corresponding group of B-terminals of the digital comparator 32. A group of A-terminals of the digital comparator 32 are connected to receive the output signals of the code converter 34 associated with the digital switches 161 and 162. The digital switches 161 and 162 generate information signals in a binary-coded decimal notation, and the code converter 34 converts the information signals from the digital switches 161, 162 into the binary notation.

A select terminal S of the data selector 36 is connected to receive a tab preset signal $T_P$ derived from a one-shot multivibrator 38 included with a tab preset signal generator 40 associated with the vertical tabulation set switch 14. Another one-shot multivibrator 42 provides an input terminal CS of the RAM 28 with an instruction signal when it receives the tab preset signal $T_P$ through an OR gate 44. Another input terminal R/W of the RAM 28 is connected to receive an inverted signal of the tab preset signal $T_P$ through an inverter 46. Still another input terminal ID of the RAM 28 is connected to receive the tab preset signal $T_P$.

A power supply circuit 48, connected to power supply of +12 volts, includes a rechargeable battery 50 of +8 volts, which is sufficient for the random access memory (RAM) 28 to hold its contents. The counter 30 is also connected to receive the power supply through the power supply circuit 48, the voltage level applied to the counter 30 being reduced to a desired value via a Zener diode 52. In this example, the voltage level applied to the counter 30 is +5 volts because the counter 30 is made of a C-MOS IC. Diodes 54 and 56, and resistors 58, 60 and 62 function, in combination, to stabilize the voltage level from the power supply circuit 48.

When a power switch 64 is closed, the RAM 28, the counter 30 and the rechargeable battery 50 receive the power supply through the power switch 64. That is, the rechargeable battery 50 is charged up when the printer is in its operative condition. When the power switch 64 is open, the rechargeable battery 50 supplies the RAM 28 and the counter 30 with a necessary voltage to maintain their contents. This avoids additional setting of the vertical tabulation positions and the counted contents when the power switch 64 is reclosed. In this example, the line number to be included within one page, namely, the termination position of the form feed operation is mechanically determined by the digital switches 161 and 162 and, therefore, the information relating to the form feed operation is not required to be set again when the power switch 64 is reclosed.

In the embodiment of FIG. 3, the digital comparator 32 and the data selector 36 are made of two SN7485's and SN54157's manufactured by TEXAS INSTRUMENTS INCORPORATED, respectively, and the counter 30 is made of MSM 5538 manufactured by OKI ELECTRIC INDUSTRY COMPANY LIMITED, Japan.

The operation mode of the vertical tabulation control circuit of FIG. 3 will be described hereinbelow with reference to a time chart of FIG. 4.

The vertical tabulation position is, first, determined through the use of the digital switches 161 and 162. Under these conditions, when the vertical tabulation set switch 14 is depressed, the tab preset signal $T_P$ is generated from the tab preset signal generator 40 and, thus the select terminal S of the data selector 36 becomes a high level, whereby the data selector 36 selects the signals from the digital switches 161 and 162 as its output signals.

When the tab preset signal $T_P$ is generated, the respective input terminals ID, R/W and CS of the random access memory (RAM) 28 receive signals as shown in FIG. 4, whereby the RAM 28 is in its reading-in condition. Therefore, the desired vertical tabulation position address determined by the digital switches 161 and 162 is preset in the RAM 28 through the data selector 36.

When the vertical tabulation set switch 14 is returned to its open condition, the tab preset signal $T_P$ disappears and, hence, the select terminal S of the data selector 36 becomes a low level, whereby the data selector 36 selects the signals from the counter 30 as its output signals. At the same time, the input terminal R/W of the RAM 28 becomes its high level and, therefore, the RAM 28 is in its reading-out condition. Under these conditons, the line number to be included within one page is preset in the A-input terminals of the digital comparator 32 through the digital switches 161 and 162 and the code converter 34.

A line feed signal LF is derived from the printer upon every line feed operation, and the counter 30 counts the number of the line feed operations. The line feed signal LF can be generated by detecting the pulse number to be applied to the pulse motor 22 included within the paper feed mechanism 10. The contents of the counter 30 are applied to the random access memory (RAM) 28 through the data selector 36, since the select terminal S of the data selector 36 receives the signal of a low level as discussed above.

When a vertical tabulation signal, VT is applied to the printer from the computer, the printer continuously performs the line feed operations till the vertical position reaches the preset vertical position address stored in the RAM 28. At this moment, the counter 30 counts the number of the line feed operations since it receives the line feed signal LF and, therefore, the RAM 28 develops a vertical tabulation termination command when the content of the counter 30 reaches the preset vertical position address stored in the RAM 28.

When a form feed signal FF is applied from the computer to the printer, the printer begins to continuously perform the line feed operations in order to skip to the following page. At this moment, the counter 30 counts the number of the line feed operations and delivers its contents to the B-input terminals of the digital comparator 32. The A-input terminals of the digital comparator 32 are connected to receive the preset signals, relating to the number of lines to be included within one page, determined by the digital switches 161 and 162 and, therefore, when the information to the A-input terminals and the B-input terminals are equal to each other, that is, when the line feed operation is achieved to the end line of one page, the digital comparator 32 develops a form feed termination command from its output terminal to the printer. The printer completes the form feed operation after an additional four line feed operations upon detecting the above-mentioned form feed termination command.

The vertical tabulation signal VT is applied to the set terminal S of a first RS flip-flop 66, whereas the vertical tabulation termination command from the random access memory (RAM) 28 is applied to the reset terminal R of the first RS flip-flop 66. The form feed signal FF is applied to the set terminal S of a second RS flip-flop 68, whereas the form feed termination command derived from the digital comparator 32 is applied to the reset terminal R of the second RS flip-flop 68. The Q outputs of the first and second RS flip-flops 66 and 68 are applied to an OR gate 70, the output signal of the latter being used as a continuous line feed command P.

It will be clear that either the vertical tabulation signal VT or the form feed signal FF functions to develop the continuous line feed command P, whereas the vertical tabulation termination command and the form feed termination command function to preclude the generation of the continuous line feed command P.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A vertical tabulation control circuit for a high speed printer in which vertical tabulation is achieved by a predetermined number of line feed operations, comprising:

a presettable memory for storing vertical tabulation addresses;

a counter for counting the number of line feed operations;

means for developing a continous line feed termination command when the contents of the counter reach a preset vertical tabulation address;

a power supply;

a power switch for activating said printer by selective interconnection thereof to said power supply; and a rechargeable battery means interconnected with said power switch, said presettable memory and said counter, which is charged from said power supply when the high speed printer is activated through said power switch, said rechargeable battery means supplying said presettable memory and said counter with a necessary voltage for maintaining their contents when the power supply to said printer through said power switch is terminated.

2. The vertical tabulation control circuit of claim 1, wherein the presettable memory is a random access memory.

3. The vertical tabulation control circuit of claim 1, which further comprises a digital switch for introducing desired vertical tabulation position information into the presettable memory.

4. In a vertical tabulation control circuit for a high speed printer which develops a continuous line feed command upon receiving a vertical tabulation signal or a form feed signal from a control system associated with the high speed printer, and receives a line feed signal from the high speed printer upon every completion of one line feed operation, the improvement comprising:

a counter connected to receive the line feed signal in order to count the number of line feed operations;

a presettable semiconductor memory for storing vertical addresses and developing a continuous line feed termination command when the contents of the counter reach the preset vertical tabulation address;

means for determining the line number to be included within one page;

a comparator for developing a continuous line feed termination command when the contents of the counter reach the predetermined line number to be included within one page;

a power supply;

a power switch for activating said printer by selective interconnection thereof to said power supply; and a rechargeable battery means interconnected with said power switch, said presettable semiconductor memory and said counter, which is charged from said power supply when the high speed printer is activated through said power switch, said rechargeable battery means supplying said presettable semiconductor memory and said counter with a necessary voltage for maintaining their contents when the power supply to said printer through said power switch is terminated.

5. The vertical tabulation control circuit of claim 4, wherein the means for determining the line number to be included within one page comprises digital switches of which output signals are applied to the comparator and the presettable semiconductor memory in order to preset a desired vertical tabulation position.

6. The vertical tabulation control circuit of claim 5, which further comprises a data selector for selectively supplying the presettable semiconductor memory with output signals of the digital switches and the counter.

7. The vertical tabulation control circuit of claim 4, wherein the presettable semiconductor memory is a random access memory.

8. In a vertical tabulation control circuit for a high speed printer which develops a continuous line feed command upon receiving a vertical tabulation signal or a form feed signal from a control system associated with the high speed printer, and receives a line feed signal from the high speed printer upon every completion of one line feed operation, the improvement comprising:

a counter connected to receive the line feed signal in order to count the number of line feed operations;

a random access memory for storing vertical tabulation addresses and developing a vertical tabulation termination command when the contents of the counter reach the preset vertical tabulation address;

digital switches for introducing desired vertical tabulation addresses into the random access memory, and for determining the line number to be included within one page;

a comparator for developing a form feed termination command when the contents of the counter reach the line number determined by the digital switches;

a power supply;

a power switch for activating said printer by selective interconnection thereof to said power supply; and a rechargeable battery means interconnected with said power switch, said random access memory and said counter, which is charged from said power supply when the high speed printer is activated through said power switch, said rechargeable battery means supplying said random access memory and said counter with a necessary voltage for maintaining their contents when the power supply to said printer through said power switch is terminated.

9. The vertical tabulation control circuit of claim 8, wherein the random access memory is supplied with a relatively high voltage when the high speed printer is activated, and is supplied with a relatively low voltage by the rechargeable battery means when the power supply through the power switch is terminated.

10. The vertical tabulation control circuit of claim 8, which further comprises:

a first RS flip-flop of which the set terminal is connected to receive the vertical tabulation signal, the reset terminal is connected to receive the vertical tabulation termination command, and the output signal is the continuous line feed command; and a second RS flip-flop of which the set terminal is connected to receive the form feed signal, the reset terminal is connected to receive the form feed termination command, and the output signal is the continuous line feed command.

11. The vertical tabulation control circuit of claim 8, which further comprises:

a vertical tabulation set switch; and a data selector for introducing output signals of the digital switches into the random access memory when the vertical tabulation set switch is closed, and introducing output signals of the counter into the random access memory when the vertical tabulation set switch is in an open condition.

* * * * *